US006269782B1

(12) United States Patent
Kayahara et al.

(10) Patent No.: US 6,269,782 B1
(45) Date of Patent: Aug. 7, 2001

(54) WATER-TUBE BOILER

(75) Inventors: Toshihiro Kayahara; Akinori Kawakami, both of Matsuyama; Takashi Morimatsu, Ichikawa; Koichi Wakae, Matsuyama; Kanta Kondou, Matsuyama; Tomohiro Ookubo, Matsuyama; Osamu Tanaka, Matsuyama, all of (JP)

(73) Assignees: Miura Co., Ltd., Matsuyama; Miura Institute of Research & Development Co., Ltd., Ehime-ken, both of (JP)

( * ) Notice: Subject to any disclaimer, the term of this patent is extended or adjusted under 35 U.S.C. 154(b) by 0 days.

(21) Appl. No.: 09/630,389

(22) Filed: Aug. 1, 2000

(30) Foreign Application Priority Data

Aug. 2, 1999 (JP) ..... 11-218447
Aug. 5, 1999 (JP) ..... 11-222011

(51) Int. Cl.[7] ..... F22B 21/34

(52) U.S. Cl. ..... 122/235.11; 122/6 A; 122/367.1; 122/367.3

(58) Field of Search ..... 122/6 A, 9, 235.11, 122/235.23, 235.32, 367.1, 367.2, 367.3; 110/234

(56) References Cited

U.S. PATENT DOCUMENTS

| | | | |
|---|---|---|---|
| 3,280,798 | 10/1966 | Blaskowski . | |
| 3,534,712 | 10/1970 | Reynolds . | |
| 3,601,098 | 8/1971 | Kraus | 122/235.11 |
| 3,633,550 | 1/1972 | Kraus | 122/235.11 |
| 3,701,340 | 10/1972 | Miller | 122/367 |
| 4,257,358 | 3/1981 | Watanabe | 122/235.11 |
| 4,453,496 | 6/1984 | Yoshinari | 122/6 A |
| 4,714,049 | 12/1987 | McCoy et al. | 122/4 D |
| 4,825,813 | 5/1989 | Yoshinari et al. | 122/6 A |
| 6,041,743 | 3/2000 | Takubo et al. | 122/367.3 |

FOREIGN PATENT DOCUMENTS

| | | |
|---|---|---|
| U712701 | 3/1995 | (JP) . |
| 9133301 | 5/1997 | (JP) . |
| 1026303 | 1/1998 | (JP) . |

*Primary Examiner*—Gregory Wilson
(74) *Attorney, Agent, or Firm*—Birch, Stewart, Kolasch & Birch, LLP

(57) ABSTRACT

Boiler efficiency is further improved and the whole boiler body is slimmed down by totally improving heat transfer surfaces confronting gas flow passages, i.e., by forming the heat transfer surface structure into three stages, and moreover by making effective use of the whole heat transfer surfaces of water tubes equipped with fully circumferentially finned water tubes. The water-tube boiler includes: an annular first water tube array made up of a plurality of water tubes and having a first opening; an annular second water tube array made up of a plurality of water tubes and having a second opening, the second water tube array being arranged outside the first water tube array; a combustion chamber provided inside the first water tube array; and a gas flow passage leading from the first opening to the second opening and defined between the two water tube arrays, wherein heat transfer surfaces confronting the gas flow passage are structured into a high-temperature heat transfer surface structure, a middle-temperature heat transfer surface structure, and a low-temperature heat transfer surface structure, as viewed from an upstream side along gas flow.

8 Claims, 9 Drawing Sheets

WATER-TUBE BOILER

BACKGROUND OF THE INVENTION

The present invention relates to boiler body structure of water-tube boilers such as once-through boilers, natural circulation water-tube boilers and forced circulation water-tube boilers.

As a body structure of water-tube boilers, there has been provided, hitherto, one in which a plurality of water tubes are arranged into an annular shape, thereby forming an inner water tube array, where a combustion chamber is defined by a space inner than the inner water tube array, while a plurality of water tubes are further arranged into an annular shape outside the inner water tube array, thereby forming an outer water tube array, where a gas flow passage is defined between the two water tube arrays. Heat transfer primarily by radiation is performed within the combustion chamber, and heat transfer primarily by convection is performed in the gas flow passage.

In this water-tube boiler, for improvement in boiler efficiency, heat transfer fins are provided on the water tubes as a measure for increasing the heat transfer area. More specifically, fully circumferential fins are provided on a specified number of outer water tubes placed near an opening formed in the outer water tube array so that the boiler efficiency can be improved (e.g., see Japanese Patent Laid-Open Gazette Hei 9-133301 (Patent Abstracts of Japan/Publication Number: 09133301A)). However, out of the heat transfer surfaces confronting the gas flow passage, it is only part of heat transfer surfaces of the outer water tube array that are improved in heat transfer surface structure. That is, the heat transfer surface structure is no more than set in two stages, the vicinities of the opening in the outer water tube array and the upstream side of the opening. Still, whereas the water tubes equipped with fully circumferential fins are provided in a region where the gas temperature is lower than a specified temperature in order to prevent the fully circumferential fins from burning out, this region is a much limited region on the downstream side out of the whole gas flow passage. Therefore, the water-tube boiler is other than designed so as to attain enough increase in heat transfer amount. Moreover, although some extent of increase in heat transfer amount can be attained by the provision of the fully circumferential fins, yet there is a need for further device in order to make effective use of the whole heat transfer surfaces of the water tubes equipped with the fully circumferential fins.

SUMMARY OF THE INVENTION

An object of the present invention is to further improve the boiler efficiency and moreover slim down the whole boiler body, by totally improving the heat transfer surfaces confronting the gas flow passage, i.e., forming the heat transfer surface structure into three stages, and also by making effective use of the whole heat transfer surfaces equipped with the fully circumferential fins.

In order to achieve the above object, the present invention provides a water-tube boiler comprising: an annular first water tube array made up of a plurality of water tubes and having a first opening; an annular second water tube array made up of a plurality of water tubes and having a second opening, the second water tube array being arranged outside the first water tube array; a combustion chamber provided inside the first water tube array; and a gas flow passage leading from the first opening to the second opening and defined between the two water tube arrays, wherein heat transfer surfaces confronting the gas flow passage are structured into a high-temperature heat transfer surface structure, a middle-temperature heat transfer surface structure, and a low-temperature heat transfer surface structure, as viewed from an upstream side along gas flow.

In an embodiment of the invention, the water-tube boiler characterized in that: the high-temperature heat transfer surface structure is a structure that the two water tube arrays are formed into a water wall structure with finless water tubes, the middle-temperature heat transfer surface structure is a structure that at least the second water tube array is formed into a water wall structure with one-side finned water tubes, and the low-temperature heat transfer surface structure is a structure that the first water tube array is formed into a water wall structure with finless water tubes while the second water tube array has fully circumferentially finned water tubes arranged so as to be spaced from one another with specified intervals.

In an embodiment of the invention, the water-tube boiler is characterized in that: the high-temperature heat transfer surface structure is a structure that the two water tube arrays are formed into a water wall structure with finless water tubes, the middle-temperature heat transfer surface structure is a structure that at least the second water tube array is formed into a water wall structure with one-side finned water tubes, and the low-temperature heat transfer surface structure is a structure that the first water tube array is formed into a water wall structure with one-side finned water tubes while the second water tube array has fully circumferentially finned water tubes arranged so as to be spaced from one another with specified intervals.

In an embodiment of the invention, the water-tube boiler is characterized in that part of the second water tube array constituting the low-temperature heat transfer surface structure is so structured that a plurality of fully circumferentially finned water tubes are arranged so as to be spaced from one another with specified intervals, and a guide member is provided outside these fully circumferentially finned water tubes.

In an embodiment of the invention, the water-tube boiler is characterized in that the guide member is formed into a projecting-and-depressing state along the fully circumferentially finned water tubes.

In an embodiment of the invention, the water-tube boiler is characterized in that a multiplicity of protrusions are provided inside the guide member.

In an embodiment of the invention, the water-tube boiler is characterized in that the one-side finned water tubes constituting the low-temperature heat transfer surface structure comprise third heat transfer fins provided so as to extend along an axis of the one-side finned water tubes, the third heat transfer fins being projecting into between the individual fully circumferentially finned water tubes.

Further, in an embodiment of the invention, the water-tube boiler is characterized in that the one-side finned water tubes constituting the low-temperature heat transfer surface structure are equipped with flat-shaped fourth heat transfer fins which are formed in multiple stages along an axis of the one-side finned water tubes and which are provided generally horizontally.

Next, embodiments of the present invention are explained. The present invention is embodied as a water-tube boiler of the multiple-tube type, and applied not only as steam boilers or hot water boilers, but also as heat medium boilers in which a heat medium is heated.

An annular first water tube array is formed of a plurality of water tubes, and a combustion chamber is defined inside this first water tube array. Outside the first water tube array, an annular second water tube array is formed of a plurality of water tubes, and a gas flow passage is defined between the second water tube array and the first water tube array. The first water tube array has a first opening formed therein, and the combustion chamber and the gas flow passage are communicated with each other by this first opening. The second water tube array has a second opening formed therein, and the gas flow passage and a flue are communicated with each other by this second opening.

The gas flow passage is classified into a high-temperature region, a middle-temperature region and a low-temperature region, as viewed from the upstream side along the gas flow, according to the gas temperature. Heat transfer surfaces confronting the gas flow passage are set to a high-temperature heat transfer surface structure, a middle-temperature heat transfer surface structure and a low-temperature heat transfer surface structure in correspondence to the above individual temperature regions. These heat transfer surface structures are set to optimum heat transfer surface structures, respectively, so that maximum heat transfer amounts can be obtained by taking into consideration thermal loads on the individual water tubes, flow resistance of the gas flow passage, burnout of heat transfer fins provided at the individual water tubes and the like, according to the gas temperature. That is, the high-temperature heat transfer surface structure is so set that the two water tube arrays are formed into a water wall structure with a plurality of finless water tubes, the middle-temperature heat transfer surface structure is so set that at least the second water tube array is formed into a water wall structure with one-side finned water tubes, and the low-temperature heat transfer surface structure is so set that the first water tube array are formed into a water wall structure with finless water tubes while the second water tube array has a plurality of fully circumferentially finned water tubes arranged so as to be spaced from one another with specified intervals.

First, the high-temperature heat transfer surface structure is described. Since gas flowing in the high-temperature region is relatively high in temperature, the high-temperature heat transfer surface structure is so structured that both water tube arrays are made up of finless water tubes, which are not equipped with heat transfer fins, so that thermal load on the water tubes does not become too high. Because thermal load on the water tubes do not become too high, scale is less deposited so that the water tubes can securely be prevented from burning out.

Next, the middle-temperature heat transfer surface structure is described. In the middle-temperature region, the gas temperature is lowered due to heat transfer in the high-temperature region, and the gas flow rate is lowered due to the resultant volume decrease, causing the heat transfer amount to be decreased proportionally. Thus, the middle-temperature heat transfer surface structure is so structured that heat transfer fins are provided on one side of the water tubes (on the gas flow passage side), thereby increasing the heat transfer area per water tube so that the heat transfer amount is increased. In the middle-temperature heat transfer surface structure, although at least the second water tube array is made up of one-side finned water tubes, yet forming the two water tube arrays from the one-side finned water tubes allows the heat transfer amount in the middle-temperature region to be further increased.

In this case, the heat transfer fins in the middle-temperature heat transfer surface structure are formed into a lateral fin shape that each heat transfer fin protrudes from the peripheral wall of the water tube toward the gas flow passage, where flat fin members are provided generally horizontally and in multiple stages along the axis of the water tubes. By the formation of the heat transfer fins into a lateral fin shape, the gas flow resistance does not increase so that a boiler body structure involving less pressure loss can be implemented. Also, the heat transfer fins may also be formed into a longitudinal fin shape that each heat transfer fin extends along the axis of the water tubes, where, for example, fin members formed into a flat-shape, a rod-shape, a generally L-shape in cross section or the like may be provided along the axis of the water tubes.

Therefore, since the middle-temperature heat transfer surface structure is made up of one-side finned water tubes, the degree of decrease in gas temperature in the middle-temperature region becomes large. As a result, the gas temperature on the downstream side of the middle-temperature region is securely lowered to such a temperature that the heat transfer fins of the fully circumferentially finned water tubes in the low-temperature region are prevented from burning out. Also, since the gas temperature is lowered to the set gas temperature of the low-temperature region at more upstream positions, the number of water tubes in the middle-temperature region can be reduced so that the length of the gas flow passage in the middle-temperature region can be shortened.

Further, the low-temperature heat transfer surface structure is described. In the low-temperature region, because the gas temperature is lowered even lower than in the middle-temperature region, the low-temperature heat transfer surface structure is so structured that the second water tube array is made up of fully circumferentially finned water tubes so that the heat transfer area per water tube is further increased. Also, in the low-temperature region, since the second water tube array is inserted into the gas flow passage, gas flows because of this inside and outside the second water tube array, allowing gas to contact with the whole peripheral walls of the water tubes and thereby heat transfer to be done, the heat transfer amount is increased to a great extent.

In this case, the fully circumferentially finned water tubes are so arranged that strip-shaped fin members are wound spirally around the peripheral walls of the water tubes, respectively. These fully circumferentially finned water tubes may also be arranged so that a plurality of disc-shaped fin members are provided so as to be separated from one another and formed in multiple stages along the axis of the water tubes. Further, the fully circumferentially finned water tubes may be so arranged that fin members divided circumferentially into a plurality of units are provided in multiple stages along the axis of the water tubes.

Furthermore, the first water tube array constituting the low-temperature heat transfer surface structure may also be formed into a water wall structure with one-side finned water tubes instead of the water wall structure with the finless water tubes. The heat transfer fins of these one-side finned water tubes are formed into the longitudinal fin shape as described before, where, for example, fin members formed into a flat-plate shape, a rod-shape, a generally L-shape in cross section, and the like are provided so that each heat transfer fin extends along the axis of the water tubes. The heat transfer fins are provided so as to project toward between the individual fully circumferentially finned water tubes of the second water tube array, thus acting also as a turbulent flow accelerating member that prevents gas from staying between the individual fully circumferentially finned water tubes. Also, the heat transfer fins may be formed into the lateral fin shape as described before, where flat-shaped fin members are provided generally horizontally and in multiple stages along the axis of the water tubes.

As described above, according to the three-stage heat transfer surface structure, the heat transfer surface structure confronting the gas flow passage is totally devised, so that the heat transfer surfaces confronting the gas flow passage can be formed into optimum heat transfer surface structures according to the gas temperature, thus allow the boiler efficiency to be markedly improved. Also, by the provision of the middle-temperature heat transfer surface structure, the gas temperature can be lowered at more upstream positions, and the low-temperature heat transfer surface structure having a large effect on increase in heat transfer amount can be provided with its starting point set at a more upstream position. Further, the number of water tubes can be reduced, as compared with boiler bodies of the same evaporation amount, so that the boiler body can be slimmed down by making the outer diameter of the boiler body smaller.

Outside the fully circumferentially finned water tubes, i.e., on the radially outer side of the second water tube array made up of fully circumferentially finned water tubes, are provided guide members which serve as gas flow passage walls. These guide members are formed into such a configuration as to let the gas flow along the outer periphery of the fully circumferentially finned water tubes, more concretely, along the radially outer heat transfer surfaces in the fully circumferentially finned water tubes, where, for example, the guide members are formed into a projecting-and-depressing shape along the outer periphery of the fully circumferentially finned water tubes. Also, the guide members are placed in generally close contact with the fully circumferentially finned water tubes, and the gas flow passage having a width corresponding to the protruding height of the fully circumferentially finned water tubes is formed between the guide members and water tubes constituting the fully circumferentially finned water tubes.

In this case, a multiplicity of protrusions may be provided inside the guide members, i.e., on one side of the guide members confronting the fully circumferentially finned water tubes. By the provision of these protrusions, when gas flows between the guide members and the fully circumferentially finned water tubes, the gas flow is disturbed, accelerating the turbulent flow, so that heat transfer amount is increased.

As shown above, according to the constitution that the guide members are provided, boiler efficiency can be further improved by making effective use of the whole heat transfer surfaces of the individual fully circumferentially finned water tubes. Consequently, by virtue of the provision of the guide members outside the fully circumferentially finned water tubes, gas flows along the outer peripheries of the individual fully circumferentially finned water tubes while gas flow rate is increased, thus allowing the whole heat transfer surfaces of the individual fully circumferentially finned water tubes to effectively act for implementation of heat transfer so that the heat transfer amount is increased to a great extent.

DETAILED DESCRIPTION OF THE PREFERRED EMBODIMENTS

Hereinbelow, embodiments in which the present invention is applied to a once-through boiler of the multiple-tube type are explained with reference to the accompanying drawings.

Figure 1:
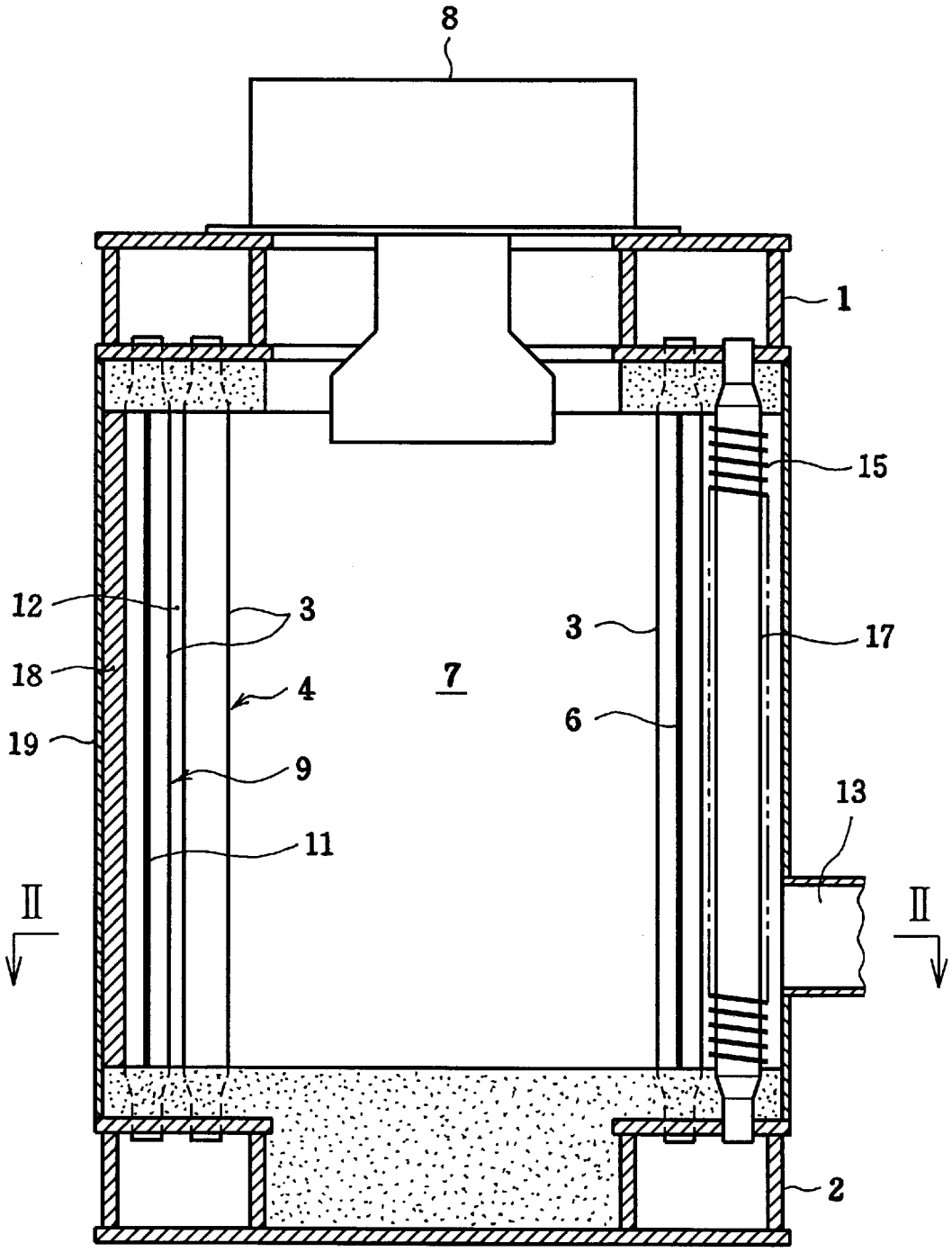
FIG. 1 is a longitudinal-section explanatory view of a first embodiment of the present invention.
Figure 2:
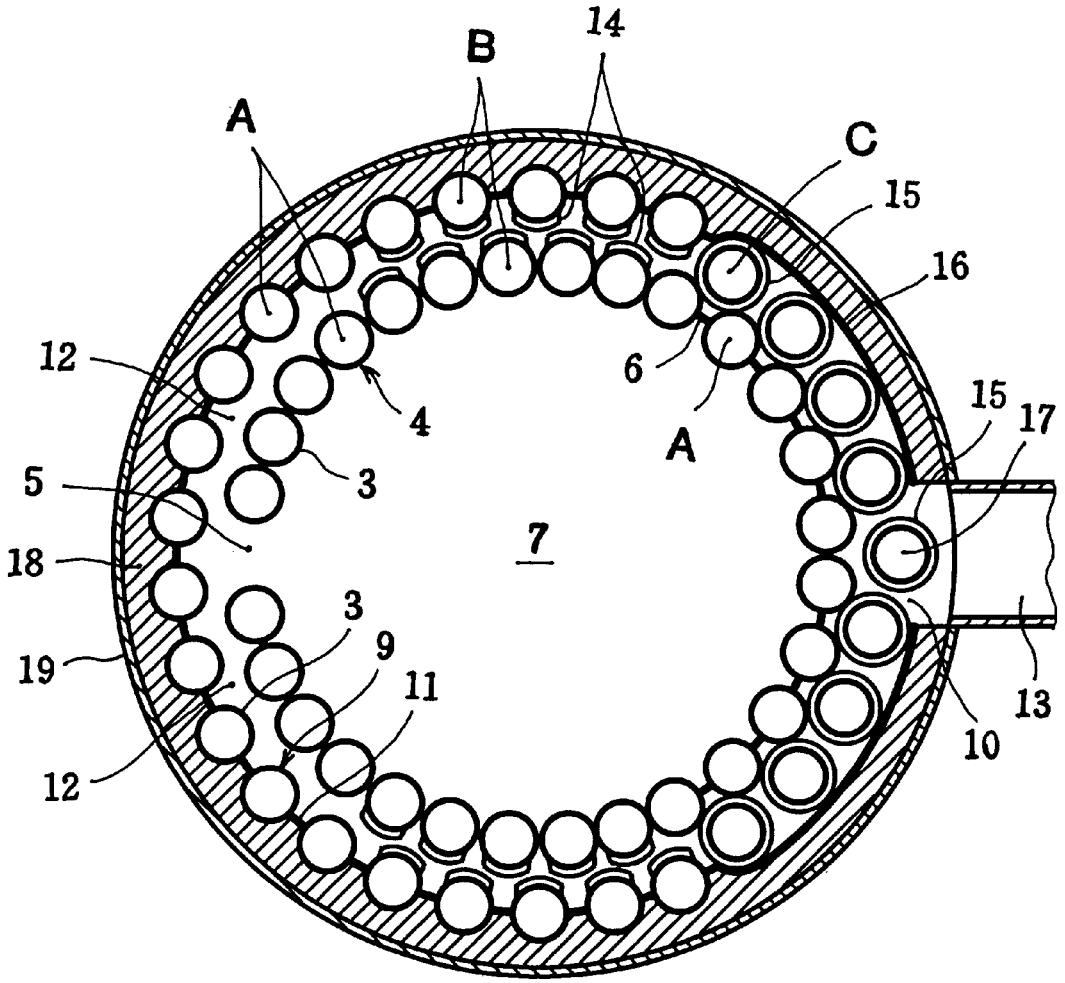
FIG. 2 is a cross-section explanatory view taken along the line II—II of FIG. 1.

Firstly, a first embodiment shown in FIGS. 1 and 2 is described. FIG. 1 is an explanatory view of a longitudinal section of the first embodiment of the invention, and FIG. 2 is an explanatory view of a cross section taken along the line II—II of FIG. 1.

Referring first to the boiler body structure, a boiler body has an upper header 1 and a lower header 2 arranged away from each other by a specified distance. A plurality of water tubes 3, 3, . . . are arranged in an annular shape between these upper header 1 and lower header 2. These water tubes 3 constitute an annular first water tube array 4 of a water wall structure, and upper and lower end portions of each water tube 3 are connected to the upper header 1 and the lower header 2, respectively. This first water tube array 4 has a first opening 5 at one portion thereof. The water tubes 3, except the first opening 5, are connected to one another in a close contact state or by first longitudinal fin members 6, 6, . . . .

A combustion chamber 7 is defined inside the first water tube array 4. Above the combustion chamber 7, a burner 8 is mounted. This burner 8 is inserted at an inward center of the upper header 1 toward the combustion chamber 7. The burner 8 is equipped with a blower (not shown).

Outside the first water tube array 4, a plurality of water tubes 3, 3, . . . are arranged in an annular shape. These water tubes 3 constitute an annular second water tube array 9, and upper and lower end portions of each water tube 3 are connected to the upper header 1 and the lower header 2, respectively. This second water tube array 9 has a second opening 10 at one portion thereof. This second opening 10 is provided about 180 degrees opposite to the first opening 5 of the first water tube array 4. Between the individual water tubes 3, except the second opening 10 and a specified-distance range of the upstream side from second opening 10, are provided second longitudinal fin members 11, 11, . . . , and the water tubes 3 are connected to one another by the second longitudinal fin members 11. The individual water tubes 3 of the first water tube array 4 and the individual water tubes 3 of the second water tube array 9 are placed with the pitch circumferentially shifted by one half.

Between the first water tube array 4 and the second water tube array 9, are provided gas flow passages 12, 12 leading from the first opening 5 to the second opening 10. These two gas flow passages 12 communicate with the combustion chamber 7 via the first opening 5, and communicate with a flue 13 via the second opening 10. Therefore, gas that has flowed out of the combustion chamber 7 is branched at the first opening 5, entering into the two gas flow passages 12, merging together at the second opening 10, and flowing into the flue 13.

In this boiler body structure, the temperature of gas flowing through the gas flow passages 12 decreases with movement toward the downstream side by heat transfer to the two water tube arrays 4, 9. Therefore, in this first embodiment, according to the degree of decrease in gas temperature, the heat transfer surface structure made up of the two water tube arrays 4, 9 confronting the gas flow passages 12 is formed into three stages, high-temperature heat transfer surface structure, middle-temperature heat transfer surface structure and low-temperature heat transfer surface structure, which are set as follows. It is noted that since the two gas flow passages 12 are generally symmetrical as passages leading from the first opening 5 to the second opening 10, the following description is made with respect to one gas flow passage 12.

First, the high-temperature heat transfer surface structure is described. The temperature of gas that has flowed into the gas flow passage 12 from the first opening 5 is about 1300° C. In the high-temperature region where gas temperature ranges from about 900° C. to about 1300° C., the two water tube arrays 4, 9 are formed into a water wall structure with a plurality of finless water tubes A, A, . . . The finless water tubes A are structured so as to be equipped with no heat transfer fins so that thermal load on the water tubes 3 does not become too high. Also, instead of providing no heat transfer fins, the gas flow rate can be increased by slightly narrowing the width of the gas flow passage 12 and thereby reducing the flow-path cross-sectional area, so that the heat transfer amount can be increased within such a range of thermal load that the water tubes 3 are not overheated.

Next, the middle-temperature heat transfer surface structure is described. In the middle-temperature region where the gas temperature ranges from about 500° C. to about 900° C., the two water tube arrays 4, 9 are formed into a water wall structure with a plurality of one-side finned water tubes B, B, . . . The one-side finned water tubes B are so structured that a multiplicity of first heat transfer fins 14, 14, . . . of lateral fin shape are provided in a multiple-step form on one side of the water tubes 3 (on the gas flow passage 12 side). Whereas decreasing gas temperature would cause the gas volume to decrease so that the gas flow rate also decreases, the provision of the one-side finned water tubes B causes the heat transfer area per water tube to increase so that the heat transfer amount also increases.

In this case, since the first heat transfer fins 14 are provided horizontally in a lateral fin shape that each first heat transfer fin 14 protrudes from the peripheral wall of the water tube 3 toward the gas flow passage 12, any increase in the gas flow resistance can be suppressed. In addition to this, since the middle-temperature region has a gas temperature of not more than about 900° C., the first heat transfer fins 14 are prevented from burning out, and the one-side finned water tubes B are prevented from being subjected to excessively high thermal load.

Also, when the placement pitch at which the first heat transfer fins 14 are placed is so set as to be the larger for upstream-side water tubes 3 and the smaller for downstream-side water tubes 3, i.e., the number of first heat transfer fins 3 to be set increases toward the downstream side, so that the heat transfer area increases along the flow of gas step by step, thermal load can be made uniform among the individual water tubes 3. The arrangement that the heat transfer area increases step by step may also be implemented by an arrangement that protruding height of the first heat transfer fins 14 from the peripheral wall of the water tubes 3 is so set as to increase toward the downstream side. Further, adjustment of the placement pitch and adjustment of the protruding height may be implemented in combination.

Further, the low-temperature heat transfer surface structure is described. In the low-temperature region where gas temperature is not more than about 500° C., the first water tube array 4 are formed into a water wall structure with a plurality of finless water tubes A, A, . . . , and the second water tube array 9 are so structured that a plurality of fully circumferentially finned water tubes C, C, . . . are spaced from one another at specified intervals. The fully circumferentially finned water tubes C have strip-shaped fin members wound spirally around the peripheral walls of the water tubes 3, respectively, as second heat transfer fins 15. Gas flows on both inside and outside the second water tube array 9, making contact with the whole outer peripheries of the individual fully circumferentially finned water tubes C, by which heat transfer is effected.

In this case, the fully circumferentially finned water tubes C are so arranged as to be generally in contact with the finless water tubes A of the first water tube array 4 at its inner side, i.e., its one side confronting the first water tube array 4. Also, outside the fully circumferentially finned water tubes C, i.e., one side opposite to the first water tube array 4, arc-shaped guide members 16, 16 serving as gas flow passage walls are set in generally contact state and symmetrically with the second opening 10 interposed therebetween. These two guide members 16 are provided as partitioning walls for the low-temperature heat transfer surface structure part. Upstream-side end portions of the guide members 16 are connected to water tubes located on the most downstream side of the second water tube array 9 constituting the middle-temperature heat transfer surface structure, respectively, while downstream-side end portions of the guide members 16 serve as end portions each defining one side of the second opening 10. Also, the two guide members 16 function to make gas flow along the fully circumferentially finned water tubes C, and to increase the heat transfer amount by narrowing the distance to the fully circumferentially finned water tubes C and thereby enhancing the gas flow rate.

In this low-temperature region, since gas flows both inside and outside the second water tube array 9, the heat transfer surfaces of the fully circumferentially finned water tubes C can be made to act effectively, while the gas flow resistance can be suppressed low. In addition to this, because the gas temperature in this low-temperature region is not more than about 500° C., the second heat transfer fins 15 and the two guide members 16 are prevented from burning out. That is, the second heat transfer fins 15 are formed smaller in thickness than the first heat transfer fins 14 of the middle-temperature region. Also, whereas the guide members 16 would be liable to burn out with high gas temperature because of no contact with water, which serves as a cooling medium, as is involved in the water tubes 3, the guide members 16 are securely prevented from burning out because the gas temperature in the low-temperature region has been lowered to about 500° C. or lower by heat transfer in the middle-temperature region. Further, thermal load on the fully circumferentially finned water tubes C never become too high.

The winding pitches of the individual second heat transfer fins 15 may be set equal among the water tubes 3, or may be arranged so that the pitch decreases which descend toward the downstream-side water tubes 3, making the heat transfer area gradually increasing. With the heat transfer area gradually increasing, thermal load can be made uniform among the individual fully circumferentially finned water tubes C.

In this first embodiment, a gas-guide water tube 17 is provided at a generally center of the second opening 10. This gas-guide water tube 17 functions to lead gas to the flue 13 while guiding the gas along the two fully circumferentially finned water tubes C, C located at the most downstream positions, i.e., both sides of the second opening 10. By the provision of the gas-guide water tube 17, heat transfer at the two fully circumferentially finned water tubes C, C located at the most downstream positions can be effectively achieved, while the gas-guide water tube 17 itself acts to collect heat so that the heat transfer amount increases. In this first embodiment, the gas-guide water tube 17 is equipped with the second heat transfer fin 15.

Outside the second water tube array 9, a heat insulating material 18 is provided, and further outside, a body cover 19 is provided.

With regard to the once-through boiler having the above constitution, its operation is described. When the burner 8 is activated, burning reaction proceeds in the combustion chamber 7, and high-temperature gas that has generally completed burning reaction enters into the gas flow passage 12 through the first opening 5. The gas, while flowing through the two gas flow passages 12, heat of the gas is transferred to heated fluid within the water tubes 3, so that the gas temperature decreases more and more with descend toward the downstream side. Gas merged at the second opening 10 is discharged outside as exhaust gas through the flue 13. Then, the heated fluid within the individual water tubes 3 goes up while being heated, and is taken out as steam from the upper header 1.

By the arrangement that the heat transfer surface structure of the two water tube arrays 4, 9 confronting the two gas flow passage 12, respectively, is formed into the three-stage heat transfer surface structure as described above, the heat transfer amount is increased so that the boiler efficiency is markedly improved. In particular, heat transfer amount in the middle-temperature region and the low-temperature region is increased to a great extent. Still, boiler efficiency can be improved without increasing the gas flow resistance as a whole, and while preventing thermal load on the water tubes from become too high. Because the gas flow resistance does not increase, a relatively low-power blower becomes usable. Also, because thermal load on the water tubes do not become too high, scale is less deposited so that the water tubes can securely be prevented from burning out.

Now the effect of providing the above middle-temperature heat transfer surface structure is described in more detail. Providing the middle-temperature heat transfer surface structure makes it possible to lower the gas temperature to about 500° C. at more upstream positions, and the low-temperature heat transfer surface structure having a large effect on increase in heat transfer amount can be provided with its starting point set at a more upstream position. This is considerably effective for further increase in heat transfer amount, in addition to the increase in heat transfer amount by the middle-temperature heat transfer surface structure.

Then, by the provision of the middle-temperature heat transfer surface structure, the lengths of the two gas flow passages 12 in the middle-temperature region can be shortened, and proportionally to this, the number of water tubes 3 can be reduced. Thus, the boiler body can be slimmed down by reducing the outer diameter of the boiler body, so that a space saving can be implemented.

According to the above heat transfer surface structure, temperature of the outer wall of the boiler body can also be suppressed low. That is, in the high-temperature region and the middle-temperature region, both of which involve relatively high gas temperatures, because the second water tube array 9 is formed into a water wall structure, outside of the second water tube array 9 is relatively low in temperature. Further, in the low-temperature region, where gas temperature has lowered, exteriors of the individual two guide members 16 are relatively low in temperature. Therefore, with this heat transfer surface structure, the two guide members 16 and the heat insulating material 18 may be implemented by those having relatively low heat resistance, and moreover the heat insulating material 18 does not need to be made thick so that the outer diameter of the boiler body can be made smaller.

Figure 3:
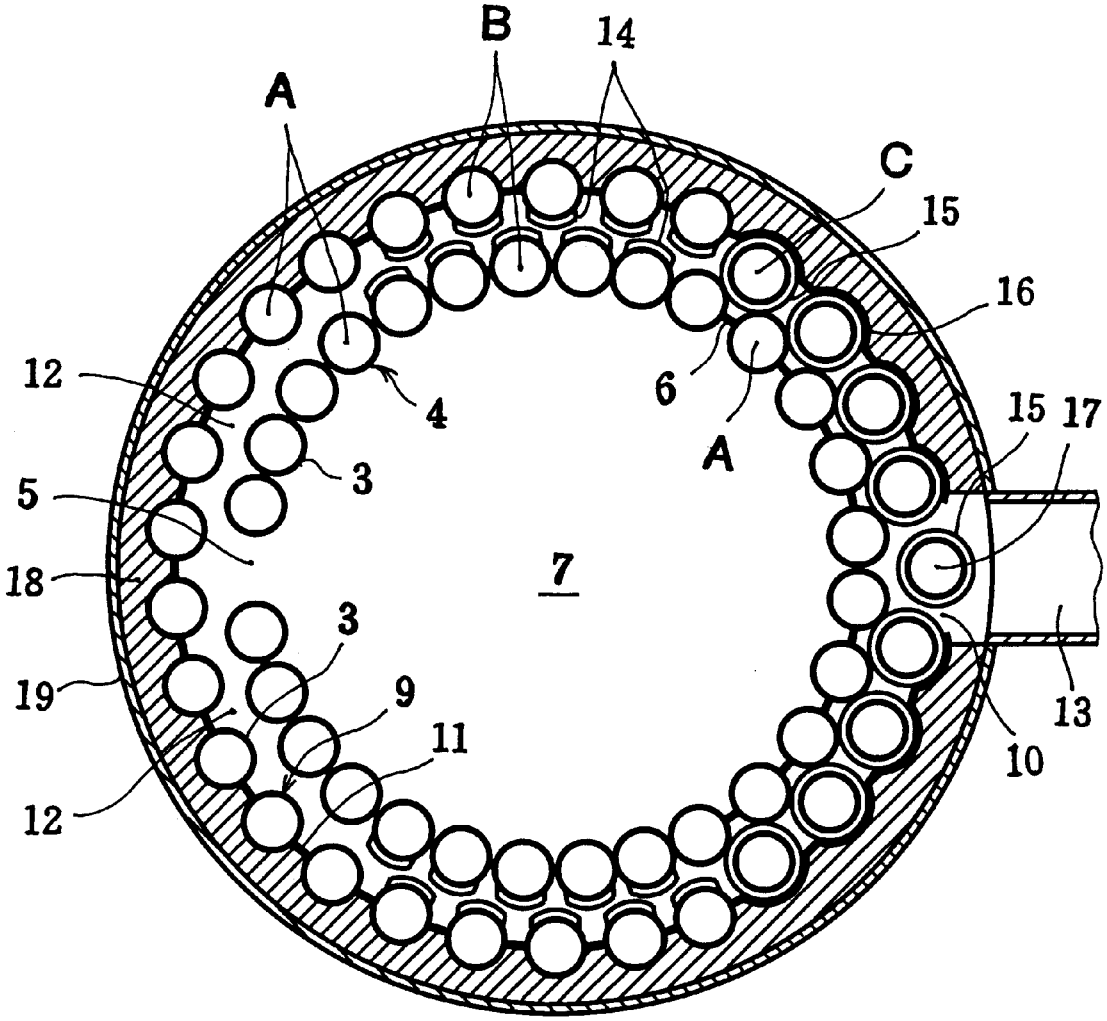
FIG. 3 is a cross-section explanatory view of a second embodiment of the invention.

Next, a second embodiment shown in FIG. 3 is described. In this case, the same constituent members as in the foregoing first embodiment are designated by the same reference numerals and their detailed description is omitted. In this second embodiment, the two guide members 16 are formed in a projecting-and-depressing state along the outer peripheries of the individual fully circumferentially finned water tubes C, i.e., along the radially outside heat transfer surfaces of the second water tube array 9 made up of the fully circumferentially finned water tubes C. Further, arc-shaped gas flow passages 12, 12 are formed between the two guide members 16 and the water tubes 3 constituting the fully circumferentially finned water tubes C, respectively. The width of these two gas flow passages 12 corresponds to the protruding height of the second heat transfer fins 15. The two guide members 16 function to let gas flow along the fully circumferentially finned water tubes C, and to narrow the distance to the individual fully circumferentially finned water tubes C so that the gas flow rate is enhanced, thereby increasing heat transfer amount.

Now the effect of providing the above two guide members 16 is described in more detail. Providing the two guide members 16 makes it possible to effectively utilize the whole heat transfer surfaces of the fully circumferentially finned water tubes C, which have a large effect on increase in heat transfer amount. That is, gas flows between the two guide members 16 and the water tubes 3 constituting the fully circumferentially finned water tubes C, while gas flows between the water tubes 3 constituting the first water tube array 4 and the water tubes 3 constituting the fully circumferentially finned water tubes C, thus the gas flowing on both inner and outer sides of the fully circumferentially finned water tubes C along the fully circumferentially finned water tubes C. Also, by the provision of the two guide members 16, the flow-passage cross section outside the fully circumferentially finned water tubes C is narrowed so that the flow rate of gas flowing outside the fully circumferentially finned water tubes C is increased, with the heat transfer amount increased. Besides, projections 22 of the two guide members 16 (see FIGS. 6 to 9) serve to prevent gas from staying between the individual fully circumferentially finned water tubes C, thus more effective for increase in heat transfer amount. Further, the two guide members 16, which are formed into a projecting-and-depressing state, are enabled to absorb expansions and contractions due to iterations of heating and cooling, thereby relaxing thermal stress, hence superior also in durability.

Figure 4:
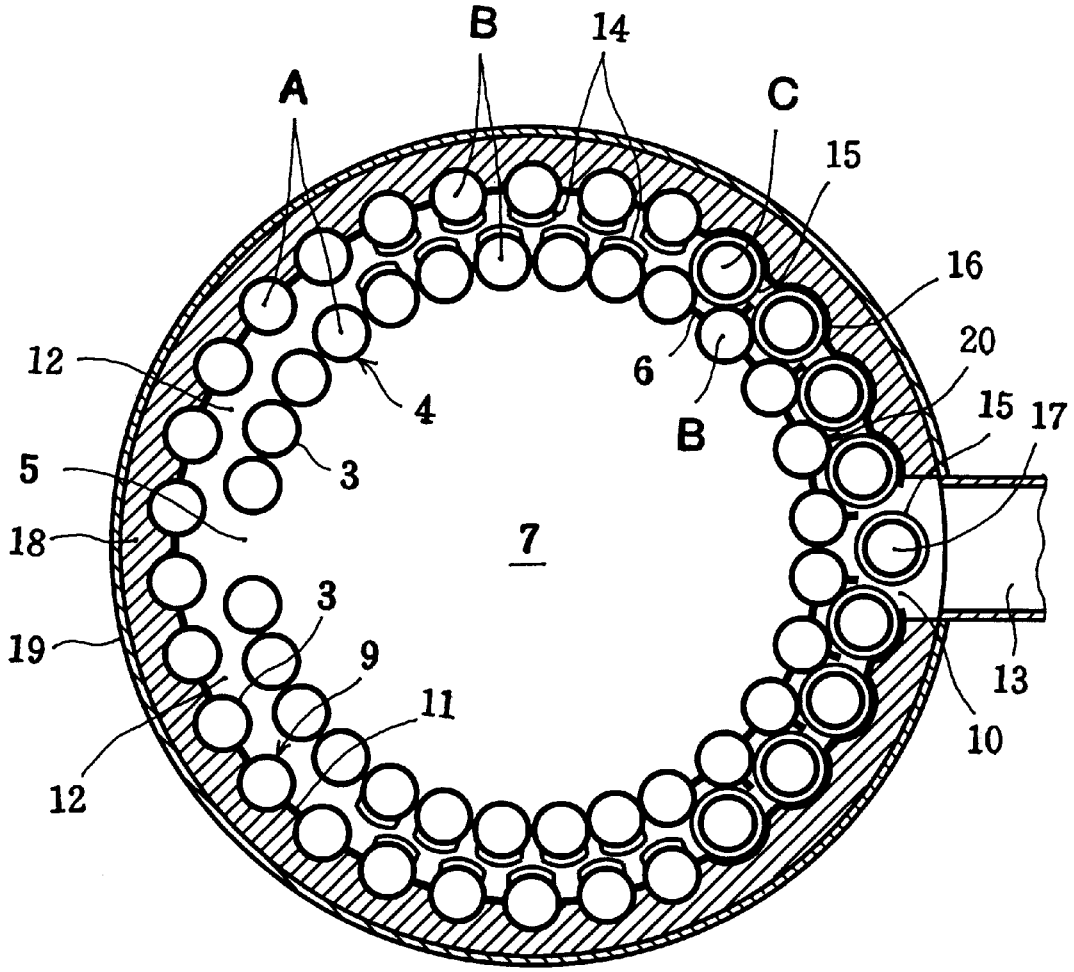
FIG. 4 is a cross-section explanatory view of a third embodiment of the invention.

Next, a third embodiment shown in FIG. 4 is described. In this case also, the same constituent members as in the foregoing embodiments are designated by the same reference numerals and their detailed description is omitted. In this third embodiment, in addition to the guide members 16, 16 in a projecting-and-depressing state of the second embodiment, the first water tube array 4 constituting the low-temperature heat transfer surface structure is formed into a water wall structure with a plurality of one-sided finned water tubes B, B, . . . , and third heat transfer fins 20 are provided as heat transfer fins for those one-side finned water tubes B, respectively. As these third heat transfer fins 20, flat-shaped fin members are provided on circumferential walls of the water tubes 3 of the first water tube array 4 so as to extend along the end portions of the third heat transfer fins 20 protrude toward between the fully circumferentially finned water tubes C of the second water tube array 9.

By the provision of the third heat transfer fins 20, gas can be prevented more effectively from staying between the fully circumferentially finned water tubes C, in addition to the gas-stay preventive effect by the projections 22 of the two guide members 16. Also, the third heat transfer fins 20 can be provided without widening the radial width of the gas flow passages 12 in a state that the fully circumferentially finned water tubes C are kept in contact with the water tubes 3 of the first water tube array 4, hence effective also for maintaining the gas flow rate and slimming down the boiler body.

Figure 5:
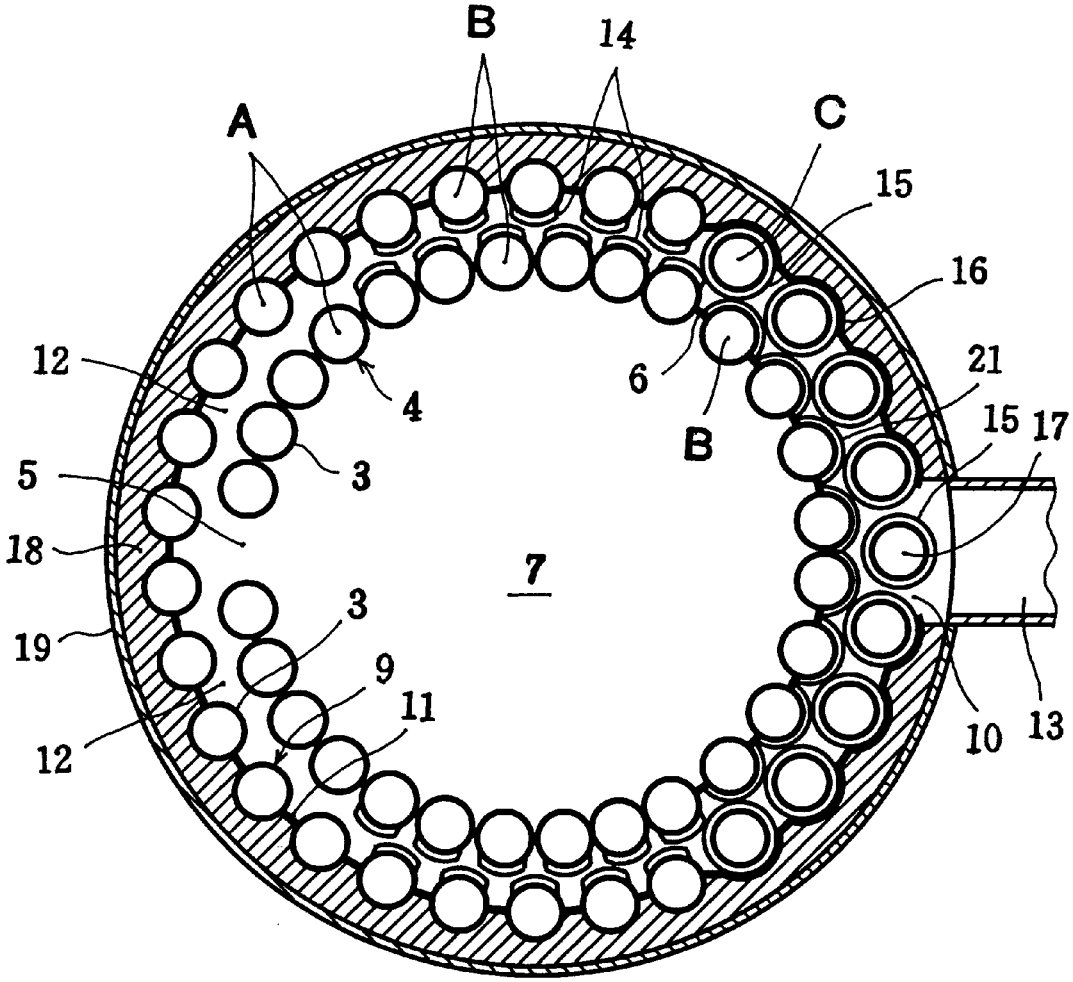
FIG. 5 is a cross-section explanatory view of a fourth embodiment of the invention.

Further, a fourth embodiment shown in FIG. 5 is described. In this case also, the same constituent members as in the foregoing embodiments are designated by the same reference numerals and their detailed description is omitted. In this fourth embodiment, fourth heat transfer fins 21, 21, . . . are provided on the first water tube array 4 of the low-temperature region. These fourth heat transfer fins 21, like the first heat transfer fins 14 of the middle-temperature region, are formed into a lateral fin shape and flat-shaped fin members are provided generally horizontally and in multiple stages along the axis of the water tubes 3. The fourth heat transfer fins 21 spread to more extent in the circumferential direction of the water tubes 3 and are larger in heat transfer area per fin, than the first heat transfer fins 14.

As shown above, as the middle-temperature heat transfer surface structure, the two water tube arrays 4, 9 are formed into a water wall structure with the one-side finned water tubes B in the foregoing embodiments. However, it may also be arranged that only one water tube array is formed into the water wall structure with the one-side finned water tubes B while the other water tube array is formed into a water wall structure with the finless water tubes A. It is also possible that the two water tube arrays 4, 9 are formed into the water wall structure with the finless water tubes A.

The above embodiments have been described with respect to a boiler body of the type that, with respect to the gas flow passages 12, gas flowing in through the first opening 5 is branched into two directions and merged together at the second opening 10. However, the present invention may be applied also to boiler bodies of the type that gas flowing in through the first opening 5 flows on in one direction so as to make one circuit along the gas flow passage 12, as described in, for example, Japanese Utility Model Laid-Open Gazette Hei 7-12701. Furthermore, the present invention may also be applied to boiler bodies of the type that a plurality of first openings 5 are provided so as to divide the first water tube array 4 generally equally in the circumferential direction so that the gas flow passage 12 is divided into a plurality of blocks in contrast to these first openings 5, as described in, for example, Japanese Patent Laid-Open Gazette Hei 10-26303 (Patent Abstract of Japan/Publication Number: 10026303A).

Next, modifications of the guide members 16 are described with reference to FIGS. 6 to 9, which show main part alone under magnification. In this case also, the same constituent members as in the foregoing embodiments are designated by the same reference numerals and their detailed description is omitted.

Figure 6:
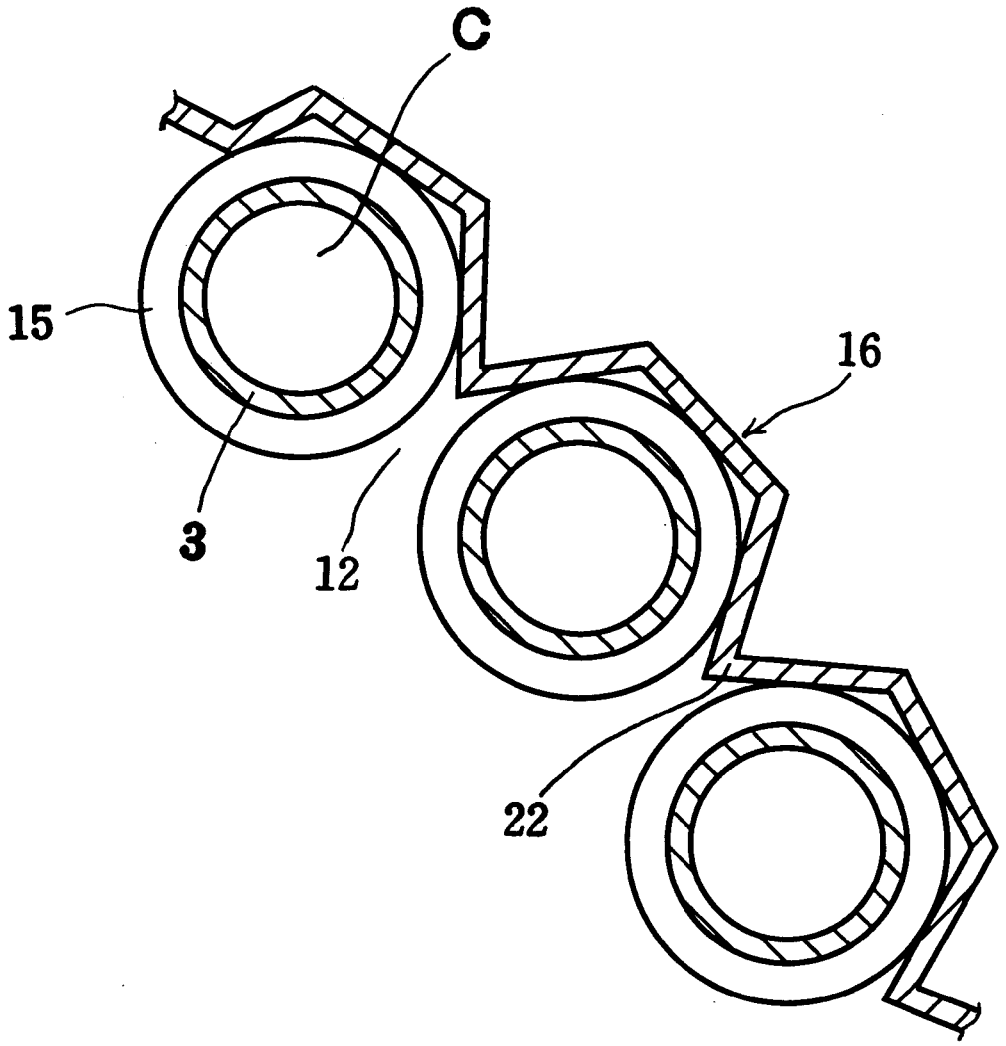
FIG. 6 is a cross-section explanatory view showing, under magnification, main part of a first modification of the guide member.

Firstly, a first modification shown in FIG. 6 is described. In this first modification, the guide member 16 is formed by bending a flat plate. Projections 22 of this guide member 16 are pointing-shaped, protruding more deeply toward between the individual fully circumferentially finned water tubes C. As a result, the guide member 16 is effective in preventing gas from staying between the individual fully circumferentially finned water tubes C.

Figure 7:
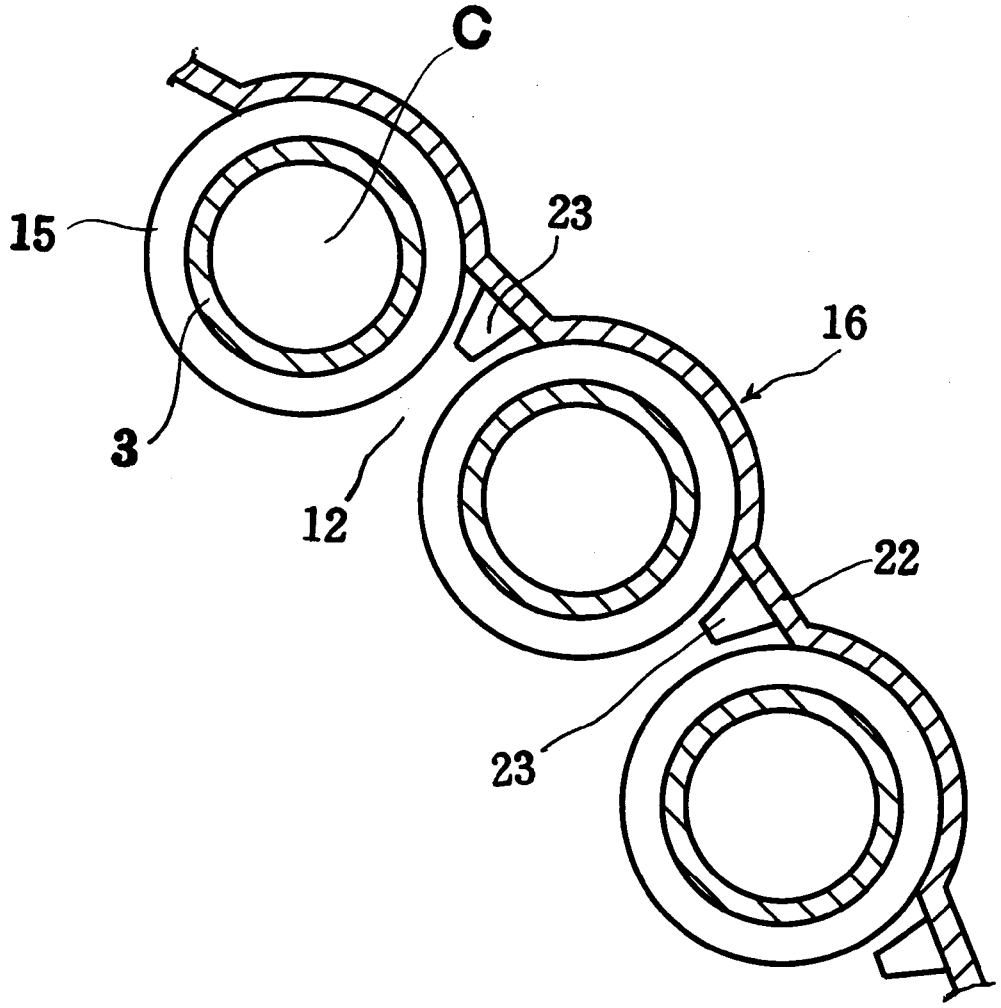
FIG. 7 is a cross-section explanatory view showing, under magnification, main part of a second modification of the guide member.

Next, a second modification shown in FIG. 7 is described. In this second modification, the guide member 16 has a multiplicity of protrusions 23, 23, . . . provided on the gas flow passage 12 side of the projections 22. These protrusions 23 are provided so as to be in multiple stages along the axis of the water tubes 3 in the state that fin members made by molding a flat plate into a trapezoidal shape is kept horizontal or tilted as required. The protrusions 23 are effective in accelerating turbulent flow between the individual fully circumferentially finned water tubes C.

Figure 8:
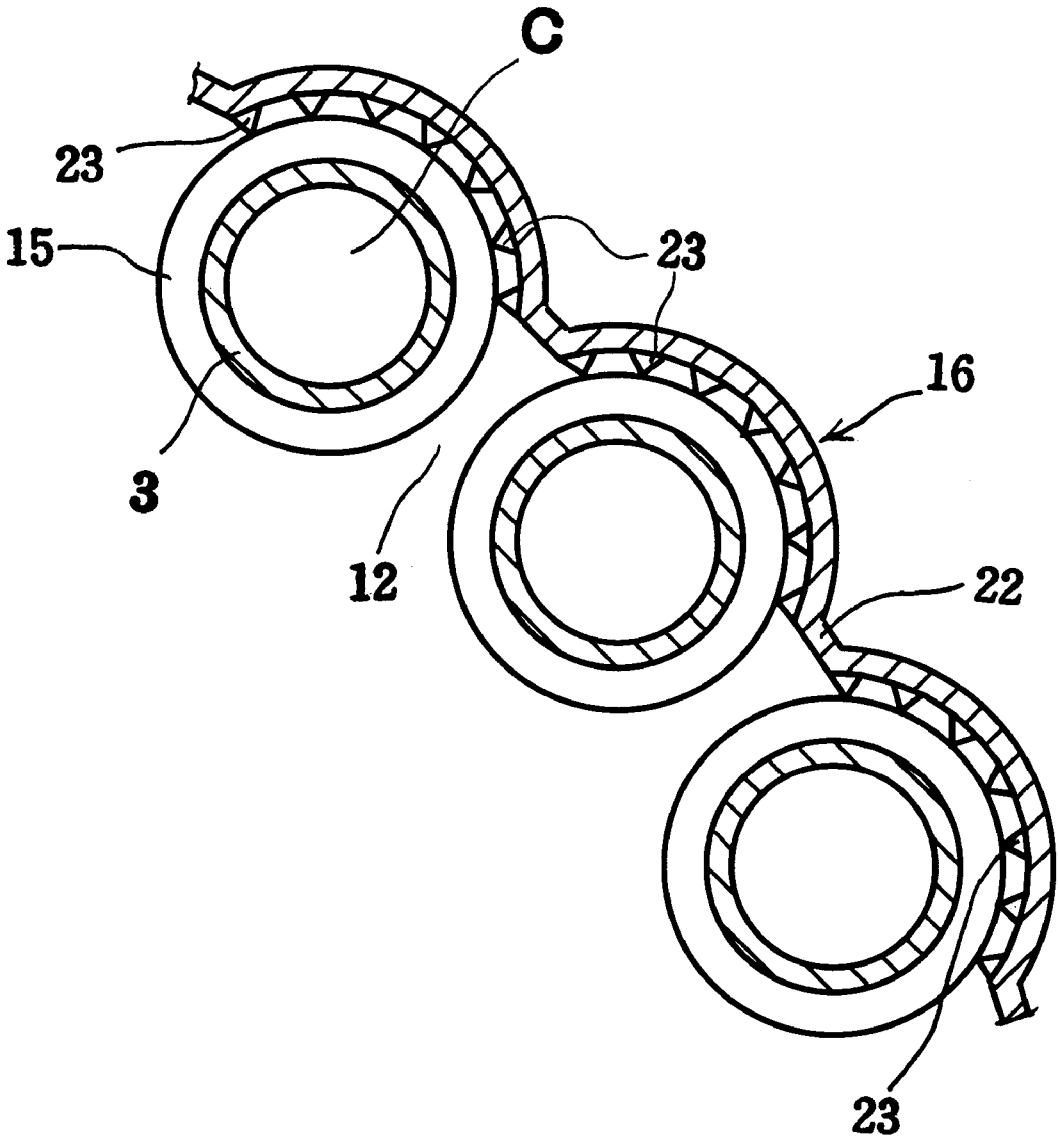
FIG. 8 is a cross-section explanatory view showing, under magnification, main part of a third modification of the guide member.

Next, a third modification shown in FIG. 8 is described. In this third modification, the guide member 16 has a multiplicity of protrusions 23, 23, . . . provided inside the guide member 16, i.e., on its one side confronting the fully circumferentially finned water tubes C. These protrusions 23 are triangular fin members provided on the entire inner side of the guide member 16. By the provision of the protrusions 23, gas flow is disturbed between the water tubes constituting the fully circumferentially finned water tubes C and the guide member 16, accelerating turbulent flow, so that the heat transfer amount is increased.

Figure 9:
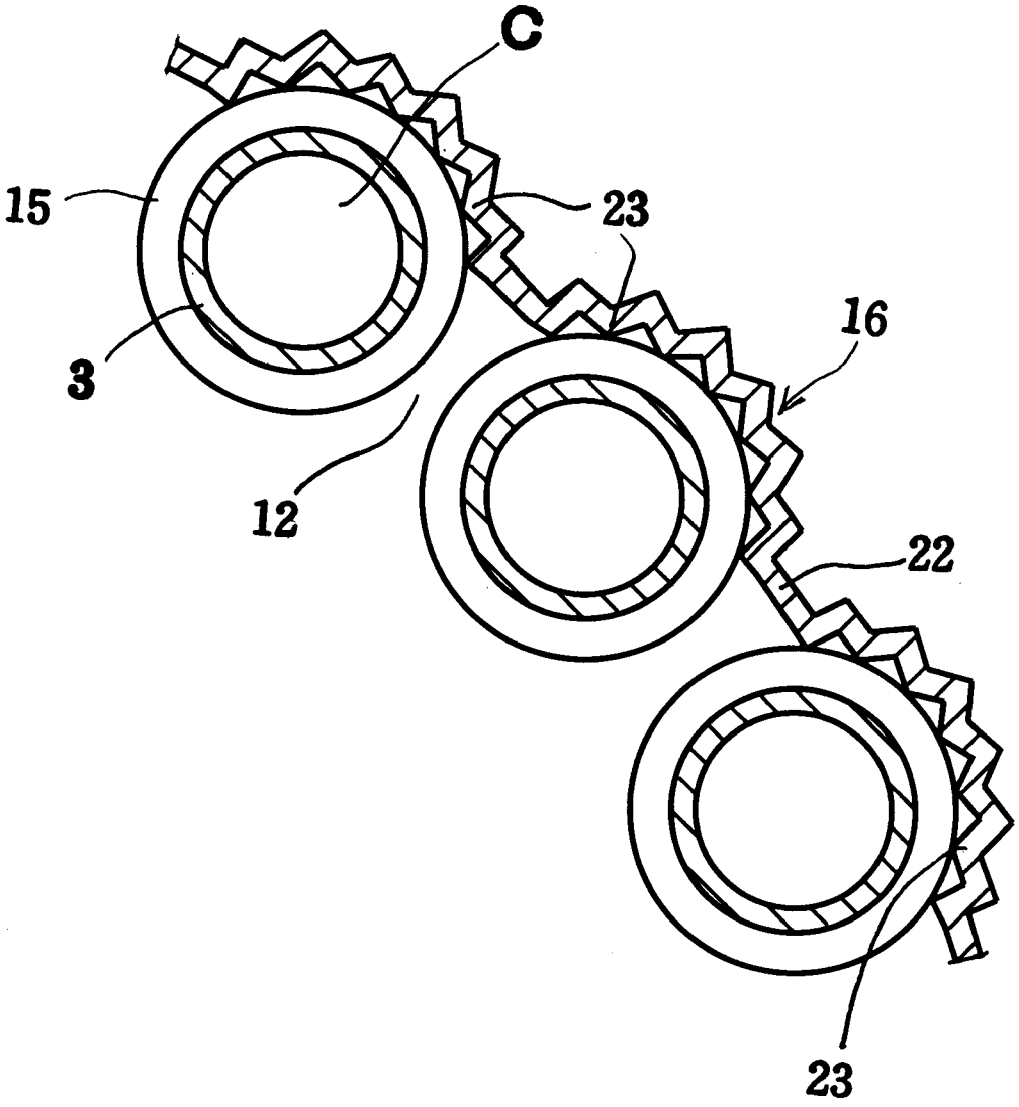
FIG. 9 is a cross-section explanatory view showing, under magnification, main part of a fourth modification of the guide member.

Further, a fourth modification shown in FIG. 9 is described. In this fourth modification, as the guide member 16, a corrugated plate is formed, by which a multiplicity of protrusions 23, 23, . . . are formed inside the guide member 16, i.e., on its one side confronting the fully circumferentially finned water tubes C. Functions of these protrusions 23 are the same as in the third modification.

According to the present invention, the heat transfer surface structure confronting the gas flow passage is totally devised so as to be formed into a three-stage heat transfer surface structure, by which an optimum heat transfer surface structure can be obtained according to gas temperature, so that boiler efficiency can be greatly improved. Also, by providing the middle-temperature heat transfer surface structure between the high-temperature heat transfer surface structure and the low-temperature heat transfer surface structure, gas temperature can be lowered the more at upstream positions, and the low-temperature heat transfer surface structure having a large effect on increase in heat transfer amount can be provided with its starting point set at a more upstream position. Further, the number of water tubes can be reduced, as compared with boiler bodies of the same evaporation amount, so that the boiler body can be slimmed down by making the outer diameter of the boiler body smaller.

Further according to the present invention, boiler efficiency can be further improved by making effective use of the whole heat transfer surfaces of the fully circumferentially finned water tubes. That is, because guide members are provided on the outer side of the fully circumferentially finned water tubes, gas flows along the outer peripheries of the fully circumferentially finned water tubes and moreover gas flow rate is increased. As a result of this, heat transfer can be performed by effectively operating the whole heat transfer surfaces of the fully circumferentially finned water tubes, so that heat transfer amount can be greatly improved.

What is claimed is:

1. A water-tube boiler comprising: an annular first water tube array made up of a plurality of water tubes and having a first opening; an annular second water tube array made up of a plurality of water tubes and having a second opening, the second water tube array being arranged outside the first water tube array; a combustion chamber provided inside the first water tube array; and a gas flow passage leading from the first opening to the second opening and defined between the two water tube arrays, wherein heat transfer surfaces of the water tubes confronting the gas flow passage of a high-temperature heat transfer surface structure, a middle-temperature heat transfer surface structure, and a low-temperature heat transfer surface structure as viewed from an upstream side along gas flow are different from each other.

2. The water-tube boiler according to claim 1, wherein the high-temperature heat transfer surface structure is a structure that the two water tube arrays are formed into a water wall structure with finless water tubes, the middle-temperature heat transfer surface structure is a structure that at least the second water tube array is formed into a water wall structure with one-side finned water tubes, and the low-temperature heat transfer surface structure is a structure that the first water tube array is formed into a water wall structure with finless water tubes while the second water tube array has fully circumferentially finned water tubes arranged so as to be spaced from one another with specified intervals.

3. The water-tube boiler according to claim 1, wherein the high-temperature heat transfer surface structure is a structure that the two water tube arrays are formed into a water wall structure with finless water tubes, the middle-temperature heat transfer surface structure is a structure that at least the second water tube array is formed into a water wall structure with one-side finned water tubes, and the low-temperature heat transfer surface structure is a structure that the first water tube array is formed into a water wall structure with one-side finned water tubes while the second water tube array has fully circumferentially finned water tubes arranged so as to be spaced from one another with specified intervals.

4. The water-tube boiler according to claim 1, wherein part of the second water tube array constituting the low-temperature heat transfer surface structure is so structured that a plurality of fully circumferentially finned water tubes are arranged so as to be spaced from one another with specified intervals, and a guide member is provided outside these fully circumferentially finned water tubes.

5. The water-tube boiler according to claim 4, wherein the guide member is formed into a projecting-and-depressing state along the fully circumferentially finned water tubes.

6. The water-tube boiler according to claim 4, wherein a multiplicity of protrusions are provided inside the guide member.

7. The water-tube boiler according to claim 3, wherein the one-side finned water tubes constituting the low-temperature heat transfer surface structure are equipped with third heat transfer fins provided so as to extend along an axis of the one-side finned water tubes, the third heat transfer fins being projecting into between the individual fully circumferentially finned water tubes.

8. The water-tube boiler according to claim 3, wherein the one-side finned water tubes constituting the low-temperature heat transfer surface structure are equipped with flat-shaped fourth heat transfer fins which are formed in multiple stages along an axis of the one-side finned water tubes and which are provided generally horizontally.

* * * * *